United States Patent [19]

Altherr

[11] Patent Number: 4,593,827

[45] **Date of Patent: * Jun. 10, 1986**

[54] RAILWAY CAR DRAWBAR CONNECTION WITH GUIDED SLACK ADJUSTING WEDGES

[75] Inventor: Russell G. Altherr, Munster, Ind.

[73] Assignee: AMSTED Industries Incorporated, Chicago, Ill.

[ * ] Notice: The portion of the term of this patent subsequent to Jun. 10, 2003 has been disclaimed.

[21] Appl. No.: 561,873

[22] Filed: Dec. 15, 1983

[51] Int. Cl.[4] ..... B61G 9/00

[52] U.S. Cl. ..... 213/50; 213/56; 213/62 R

[58] Field of Search ..... 213/64, 75 R, 69, 67 R, 213/188, 62 R, 62 A, 72 R, 50, 56; 105/3, 4 R, 207; 308/244; 384/267, 268, 269

[56] References Cited

U.S. PATENT DOCUMENTS

| | | | |
|---|---|---|---|
| 260,345 | 6/1882 | Zastrow | 384/267 |
| 1,082,269 | 12/1913 | Jackson | 213/64 |
| 3,400,834 | 9/1968 | Zanow | 213/64 |
| 3,716,146 | 2/1973 | Altherr | 213/64 |
| 3,717,106 | 2/1973 | Henricot | 105/207 |
| 4,336,758 | 6/1982 | Radwill | 105/4 R |
| 4,456,133 | 6/1984 | Altherr et al. | 213/69 |

*Primary Examiner*—Randolph A. Reese
*Assistant Examiner*—Dennis C. Rodgers
*Attorney, Agent, or Firm*—Charles E. Bouton; Edward J. Brosius

[57] ABSTRACT

The present invention relates to a drawbar railway coupler connection. The drawbar contacts a follower block which in turn contacts a wedge shaped shim. Such shim provides an essentially slackless feature to the coupling connection. Further, surfaces of the follower block and the shim or of the shim and the rear cavity wall are modified such that alignment of the shim within the cavity is assured despite any angling or slight rotation of the drawbar.

3 Claims, 5 Drawing Figures

RAILWAY CAR DRAWBAR CONNECTION WITH GUIDED SLACK ADJUSTING WEDGES

BACKGROUND OF THE INVENTION

The present invention relates to railway car coupling arrangements and, more particularly, to drawbar connections with slack adjusting wedges.

With the higher loads carried by modern railway trains, it is important to maintain close butted relationships between coupler draft components to lessen impact forces under buff conditions. Since most drawbar connection parts are cast with little or no finish machining to provide dimensional control, it is desirable to provide a coupling device which is self adjusting under various wear conditions to lessen the slack in such connections. One type of self adjusting articulated connection is shown in U.S. Pat. No. 3,716,146.

In slackless drawbar coupling arrangements, the drawbar extends between the sides of the car sill. The butt end of the drawbar is arcuate convex and abuts a complementary front concave surface of a follower block. The back surface of the follower abuts the front surface of a wedge shim which has a rear surface that abuts the rear wall of the pocket casting within the car sill. Either or both of the front and rear surfaces of the shim member diverge upwardly to provide the gravity assisted wedging force which makes the coupling arrangement slackless. When the butting surfaces become worn, the shim member drops slightly to maintain the essentially slackless connection.

In the pocket casting of the drawbar coupling arrangement, top, bottom and vertically disposed side walls provide a cavity for the follower and the shim. The side walls limit the lateral translation and therefore rotation of the follower about the vertical axis of arcuate butt end of the drawbar upon the horizontal angling of the drawbar. Such rotation of the follower may cause the wedge shim to rotate about the car longitudinal axis and possibly hang up between the vertical walls, especially when the shim is small in height relative to its width. The known method of controlling such rotation of the follower and the relative orientation between the shim and the follower is to provide for a very close tolerance between the vertical side walls of the cavity and the shim and the follower side edges. Due to the cast nature of such components the procedure requires an uneconomical amount of tolerance design and machining of finished parts.

Accordingly, it is an object of the present invention to provide an improved slackless drawbar coupling arrangement.

SUMMARY OF THE INVENTION

The present invention provides an improved slackless drawbar coupling arrangement. In such coupling arrangements, the drawbar extends into the car center sill. Within the center sill are a follower block and a wedge shim. The front surface of follower block has an arcuate concave section which abuts the arcuate convex end of the the drawbar. The rear surface of the follower block is of a generally convex shape comprising two generally planar surfaces joined at a vertex substantially in the vertical center plane of the car. Each planar surface extends away from a vertical transverse plane at an angle of 0°–20°.

A wedge shim is located between the follower block and the rear cavity wall of the pocket casting. Either the front surface or the rear surface or both of the surfaces of the wedge shim are sloped from the vertical to form an upwardly diverging member. The front surface of the shim comprises two generally flat surfaces joined at a vertical center axis. Such surfaces extend from said axis at angles of 0°–20° from a horizontal plane through the center vertical axis to form a generally concave surface which is complementary to and abuts the convex surface of the follower block. The rear surface of the shim is generally flat and abuts the rear cavity wall of the pocket casting.

In an alternative embodiment of the present invention, the rear surface of the follower block is generally flat as is the front surface of the shim. However, the rear surface of the shim comprises two generally flat surfaces joined at a center vertical axis. Such surfaces extend from said axis at angles of 0°–20° from the horizontal to form a generally convex surface. A complementary concave surface is formed on the rear cavity wall of the pocket casting.

Other alternative embodiments of the present invention include the follower block-shim interface wherein the follower block rear surface is concave and the complementary front surface of the shim is convex. Another embodiment would include the follower block rear surface being concave and the rear cavity wall of the pocket casting being convex.

The present invention provides a railway coupler drawbar arrangement comprising a drawbar having an elongated shank portion, a convex butt end and a slot through said shank, a casting having a pocket therein with a generally flat inclined rear surface, a follower block having a front concave surface abutting the convex butt end of said drawbar and a rear surface comprising two generally flat surfaces joined at a central vertical axis to form a generally convex surface, and a shim having a generally flat inclined rear wall abutting the rear surface of the casting pocket and a front surface comprising two generally flat surfaces joined at a central vertical axis to form a generally concave surface abutting the rear surface of said follower block.

The present invention also provides a railway coupler drawbar arrangement comprising a drawbar having an elongated shank portion, a convex butt end and a slot through said shank, a casting having a pocket therein, the rear wall of said pocket comprising two generally flat surfaces joined at a central vertical axis to form a generally concave surface, a follower block having a front concave surface abutting the convex butt end of said drawbar and a rear wall comprising two generally flat surfaces joined at a central vertical axis to form a generally convex surface, and a shim having a rear surface comprising two generally flat surfaces joined at a central vertical axis to form a generally convex surface abutting the rear wall of said pocket, and a front surface comprising two generally flat surfaces joined at a central vertical axis to form a generally concave surface abutting the rear surface of said follower block.

In summary, the present invention relates to the prevention of relative lateral translation between the components of a railway coupler arrangement. In one embodiment, the abutting surfaces of the wedge shim and the follower block are each comprised of two generally planar surfaces joined at a center vertical axis to form a convex surface on the follower block and a concave surface on the wedge shim. Accordingly, relative lateral translation between the shim and the follower is prohibited. In another embodiment, the abutting surfaces of the wedge shim and the rear wall of the pocket casting are each comprised of two generally planar surfaces joined at a center vertical axis to form a convex wall on the shim and a concave surface on the pocket. Accordingly, relative lateral translation between the shim and the follower is prohibited. In another embodiment, the abutting surfaces of the wedge shim and the follower block and the abutting surfaces of the wedge shim and the rear wall of the pocket casting are comprised of the concave-convex surfaces described above. Accordingly, relative translation between the shim, the follower and the side casting is prohibited.

DESCRIPTION OF THE PREFERRED EMBODIMENT

Figures 1, 2, 3, 4, 5:
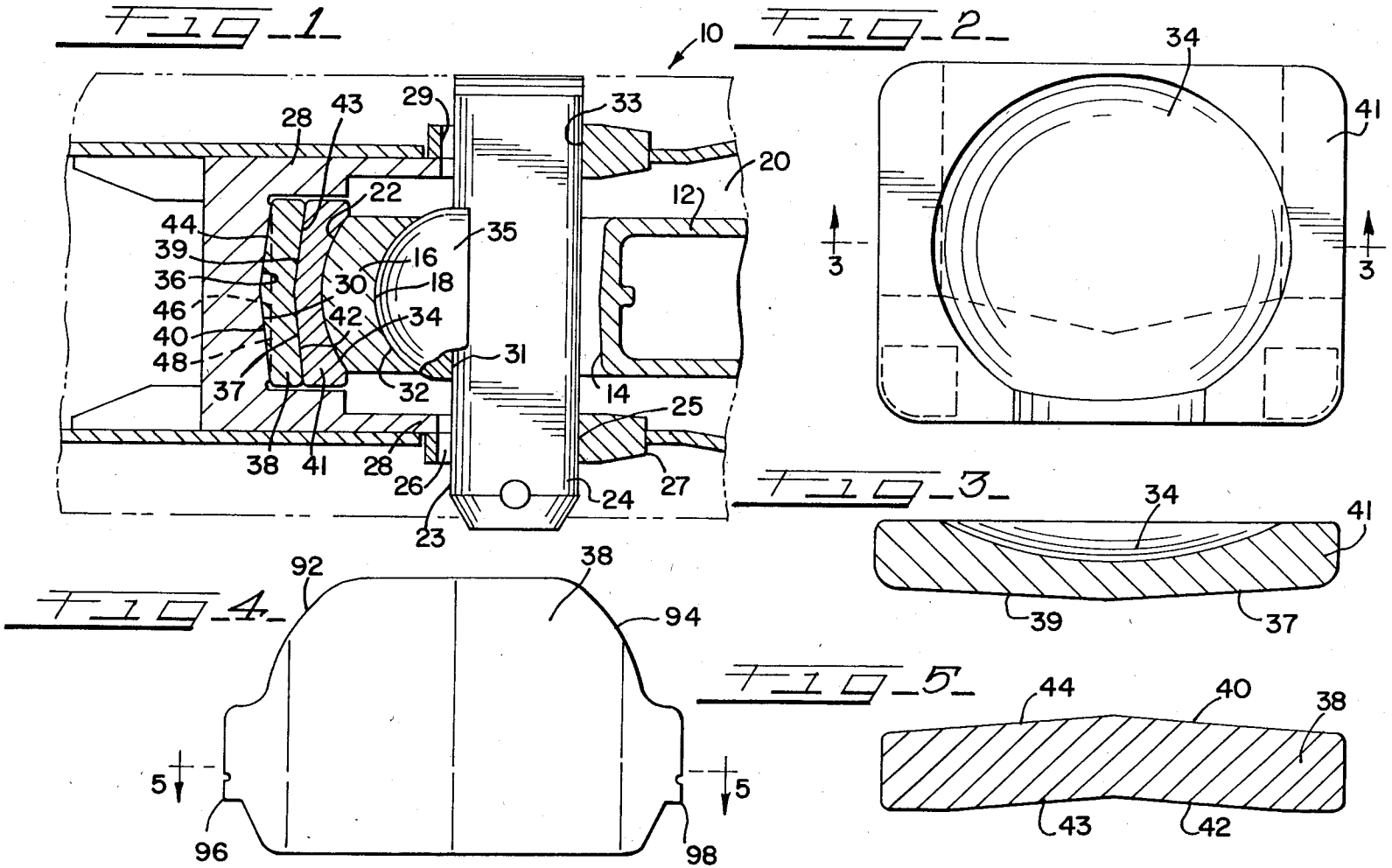
FIG. 1 is a top view in partial cross section of a drawbar connection showing the shim-follower block interface and a shim-pocket wall interface.
FIG. 2 is a front view of a follower block.
FIG. 3 is a cross section of a follower block along lines 3—3 of FIG. 2.
FIG. 4 is a front view of a wedge shim.
FIG. 5 is a cross section of a wedge shim along lines 5—5 of FIG. 4.

Referring now to FIG. 1, a drawbar coupler connection is shown generally at 10. Drawbar 12 extends along its longitudinal axis into car center sill 20. Drawbar 12 ends in arcuate butt section 16 having a convex surface 22. Pin or key 24 is of an elongated bar shape having cylindrical edge surface 25 in mating engagement with concave surface 33 of opening 26 in side casting 27, and extends through key-slot 14 and opening 26 in side casting 27. Key bearing block 35 has a concave cylindrical front surface 31 that abuts rear convex surface 23 of key 24 and has a convex curved surface 32 which abuts curved surface 18 of drawbar 12.

Pocket casting 28 fits within car center sill 20 at a predetermined longitudinal spacing from opening 26 of side casting 27. Follower block 41 is located within pocket casting 28. Follower block 41 has an arcuate concave front surface 34 that abuts convex curved surface 22 of drawbar butt section 16. Follower block 41 has a rear surface comprising two flat surfaces 37 and 39 joined at a center vertical axis at an angle of from 140° to 180° to form a generally convex surface. Wedge shaped shim 38 has a rear surface comprising two flat surfaces 40 and 44 joined at a center vertical axis at an angle of from 140° to 180° to form a generally convex surface. Shim rear surfaces 40 and 44 abut interior rear wall of pocket casting 28. The rear wall of pocket casting 28 comprises two flat surfaces 30 and 36 joined at a center vertical axis at an angle of from 140° to 180° to form a generally concave wall. Shim rear surfaces 40 and 44 diverge from its front center axis vertically to provide the wedge gravity induced force of shim 38. Shim 38 has a front surface comprising two flat surfaces 42 and 43 joined at a center vertical axis at an angle of from 140° to 180° to form a generally concave surface. Such shim front concave surface abuts the rear convex surface of follower block 41 to assure the alignment of the two elements. Alternatively, shim rear surface 46 can be generally flat and rear wall 48 of pocket 28 can be generally flat and can meet along a generally flat surface that is vertically inclined to provide the wedge effect.

For a more detailed view of follower block 41 FIGS. 2–3 are now referred to. A front view of the follower block 41 is provided in FIG. 2. Follower block 41 is of a generally rectangular shape, having an arcuate concave surface 34 on the front face. In FIG. 3, a cross section of the follower block 41 is shown. Generally flat surfaces 37 and 39 comprise each half of the rear face of the follower block 41. Such faces are joined at a center vertical axis at an angle of from 140°–180° to form a convex face of follower block 41. Alternatively, this arrangement could be described by stating that surfaces 37 and 39 each extend at an angle between 0° and 20° from a transverse plane containing said center axis.

For a more detailed view of the wedge shim 38, FIGS. 4–5 are now referred to. A front view of shim 38 is shown in FIG. 4. Shim 38 is of a generally rectangular shape, with upper corner 92, 94 rounded and tabs 96, 98 extending from both sides. In FIG. 5, a cross section of shim 38 is shown. Generally flat surfaces 40 and 44 comprise each half of convex rear face of follower block 38. Generally flat surfaces 42 and 43 comprise each half of the front face of shim 38. Such faces are joined at a center vertical axis at an angle of from 140° to 180° to form a concave face of shim 38. Alternatively, this arrangement could be described by stating that surfaces 42 and 43 each extend at an angle of from 0° to 20° from a transverse plane containing said center axis and parallel to the longitudinal center line of shim 38.

What is claimed is:

1. In a railway coupler drawbar arrangement including a drawbar having an elongated shank portion, and a convex butt end received within a center sill and held therein by a key extending through a slot in said shank, the improvement comprising:

a pocket casting with a generally flat inclined, rear wall located within the center sill, a follower block located within said pocket casting said follower block having a front concave surface for abutting the convex butt end of said drawbar and a rear surface comprising two generally flat surfaces joined at a central vertical axis to form a generally convex surface, and a wedge shaped shim having a generally flat inclined rear surface abutting said rear wall of said pocket, and a front surface comprising two generally flat surfaces joined at a central vertical axis to form a generally concave surface complementary to the said generally convex rear surface of said follower block and abutting said rear surface of said follower block.

2. The apparatus of claim 1, wherein the shim front surfaces extend at an angle from 0°–20° from a horizontal through the central vertical axis and the follower block rear surfaces extend at an angle from 0°–20° from a horizontal through the central vertical axis.

3. In a railway coupler drawbar arrangement comprising a drawbar having an elongated shank portion, a convex butt end received within a center sill and held therein by a key extending through a slot in said shank, the improvement comprising:

a pocket casting therein, the rear wall of said pocket comprising two generally flat surfaces joined at a central vertical axis to form a generally concave surface, a follower block located within said pocket casting said follower block having a front concave surface for abutting the convex butt end of said drawbar and a rear surface comprising two generally flat surfaces joined at a central vertical axis to form a generally convex surface, and a wedge shaped shim positioned between said follower block and said pocket casting said shim having a rear surface comprising two generally flat surfaces joined at a central vertical axis to form a generally convex surface complementary to and abutting the rear wall of said pocket, and a front surface comprising two generally flat surfaces joined at a central vertical axis to form a generally concave surface complementary to and abutting the rear surface of said follower block and wherein at least one of the rear surface and front surface of said shim is sloped from the vertical to form an upwardly diverging member.

* * * * *